United States Patent [19]

Hung

[11] Patent Number: 4,889,281

[45] Date of Patent: Dec. 26, 1989

[54] SLIDING RAIL CONSTRUCTION FOR THE ROWING EXERCISING MACHINE

[76] Inventor: Michael Hung, 11th Floor, 624, Ming Chuan East Road, Taipei, Taiwan

[21] Appl. No.: 234,801

[22] Filed: Aug. 22, 1988

[51] Int. Cl.[4] ..... E01B 5/08; A63B 69/06

[52] U.S. Cl. ..... 238/143; 272/72

[58] Field of Search ..... 238/143, 138, 139, 146; 272/72

[56] References Cited

U.S. PATENT DOCUMENTS

| | | | |
|---|---|---|---|
| 1,647,665 | 11/1927 | Riche | 238/146 |
| 3,602,655 | 8/1968 | Donald | 238/143 |
| 3,885,655 | 5/1975 | Corl et al. | 238/143 |
| 4,125,199 | 11/1978 | Abels et al. | 414/671 |

FOREIGN PATENT DOCUMENTS

| | | | |
|---|---|---|---|
| 182231 | 7/1922 | United Kingdom | 238/143 |

OTHER PUBLICATIONS

Sears catalog 1987, "Exercise Rowers", (no page number).

*Primary Examiner*—Andres Kashnikow
*Assistant Examiner*—Mark T. Le
*Attorney, Agent, or Firm*—Ladas & Parry

[57] ABSTRACT

The present invention relates to an improved sliding rail construction for rowing exercising machine, in which, the sliding rail for rowing exercising machine is formed by combining an upper sliding stripe made of aluminum alloy and a rail base made of ferrous metal together, and which permits the whole sliding rail construction to be more easily connected to the base rods while providing very good sliding ability for the seat pad placed thereon. Thus the present invention is capable of reducing the production cost, simplifying the manufacturing process and improving the quality of the rowing exercising machine.

3 Claims, 3 Drawing Sheets

SLIDING RAIL CONSTRUCTION FOR THE ROWING EXERCISING MACHINE

FIELD OF THE INVENTION

This invention relates to an improved sliding rail construction for the rowing exercising machine.

BACKGROUND OF THE INVENTION

A rowing exercising machine is an indoor exercising device which permits the user to imitate the movements of rowing a boat. Since such a device can provide excellent exercising effects, it has been widely used by the consumers.

The rowing exercising machine generally comprises rowing rods, sliding rail and seat pat, in which, the seat pad is supported by the sliding rail and is able to slide back and forth upon the sliding rail. When using the rowing exercising machine, the user can sit on the seat pad and rows two rowing rods with both hands in conjunction with the movement of the legs to move his body forward and backward by means of sliding the seat pad along the sliding rail. Therefore, a high quality rowing exercising machine, which provides very good sliding ability between the seat pad and the sliding rail, is desired.

Besides, in order to maintain the stability of the rowing exercising machine when it is placed on the ground for use, it is necessary to secure the sliding rail on a number of supporting base rods placed in transverse direction. For a rowing exercising machine which is more affordable for the consumers, the sliding rail and the base rods are made of ferrous metal, and then connected to each other by welding. However, the quality of such a product is usually not satisfactory due to its poor sliding ability of its seat pad. Since the surface of the aluminum alloy can provide better smoothness with higher precision without excessive machining, for the products of higher quality, the sliding rail and base rods are made of aluminum alloy which improves the sliding ability between the seat pad and sliding rail and obviously upgrades its utilization value. However, a sliding rail construction made of aluminum alloy will produce following difficulties with respect to the production cost and manufacturing process:

1. Since the whole set of the sliding rail is made of aluminum alloy by extrusion and drawing and the price of aluminum alloy is higher than that of ferrous metal, the production cost will be higher and hence the price of the final product will also be increased. Such a price might deter a lot of potential buyers.

2. Since the main components are made of aluminum alloy, the connection between the sliding rail and base rods has to be formed by Argon welding. Such a welding technique is very difficult to perform and its cost is much higher than that of the welding for other metallic materials. This will also increase the production cost of the product.

3. Instead of welding directly between the aluminum alloys, the connection between the sliding rail and base rods can also be achieved by screws. However, in order to use screws for connection, it is necessary to provide securing means and threaded holes in advance, which obviously complicate the assembling process of the product and also renders higher cost.

An improved sliding rail construction is therefore desired to overcome the above mentioned problems and drawbacks.

SUMMARY OF THE INVENTION

It is an object of the present invention to provide an improved design of the sliding rail for the rowing exercising machine, wherein the sliding rail comprises an upper sliding stripe made of aluminum alloy, and a rail base made of ferrous metal. Through mounting means provided on the upper sliding stripe and holding means provided on the rail base, the upper sliding stripe can thus be connected to the rail base so as to form the sliding rail. Such a combination allows the rail base to be fixed on the base rods, which are also made of ferrous metal, by conventional welding technique and by the installation of the upper sliding stripe made of aluminum alloy, the sliding ability of the seat pad is therefore improved. Thus the present invention enables the reduction of the production cost, simplifies the manufacturing process and improves the quality of the product.

BRIEF DESCRIPTION OF THE DRAWING

The invention will be more fully understood from the following detailed description thereof, taken in conjunction with the accompanying drawings, in which.

DESCRIPTION OF PREFERRED EMBODIMENTS

Figure 1:
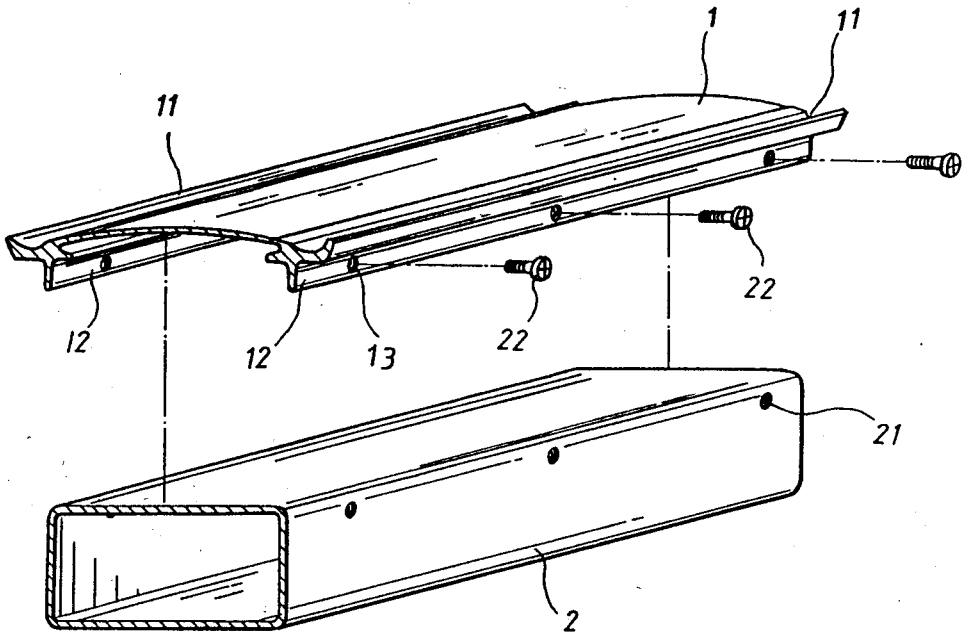
FIG. 1 is an exploded view of the sliding construction of the present invention.
Figure 2:
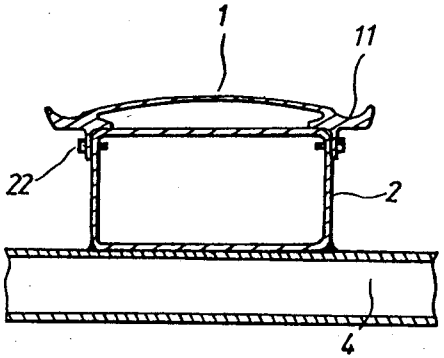
FIG. 2 is a section view of the sliding rail construction of the present invention after assembling.

As shown in FIGS. 1 2, the sliding rail construction of the present invention mainly comprises an upper sliding stripe 1 and rail base 2. The upper sliding stripe 1 is made of aluminum alloy by extrusion and drawing, and its upper surface provides two troughs 11 individually adjacent to both sides of the stripe. On the bottom surface of the upper sliding stripe, two flanges projecting downwardly are formed adjacent to both sides of the upper sliding stripe, and a plurality of bolt holes 13 are formed equidistantly on the sides of the both flanges 12. The rail base 2 is made of shape iron with rectangular cross section and on both of its vertical sides, a plurality of threaded holes 21 are provided corresponding to the bolt holes 13 on the flanges 12. The width of the rail base 2 is about the same as the width between the confronting surfaces of the two flanges 12 formed under the upper sliding stripe 1, and thus the upper sliding stripe 1 is able to mount upon the rail base 2 steadily which also aligns the holes 13 and 21. With screws 22, the sliding stripe 1 is locked and secured on the rail base 2, and thus provides connection between the upper sliding stripe 1 and rail base 2.

Figure 5:
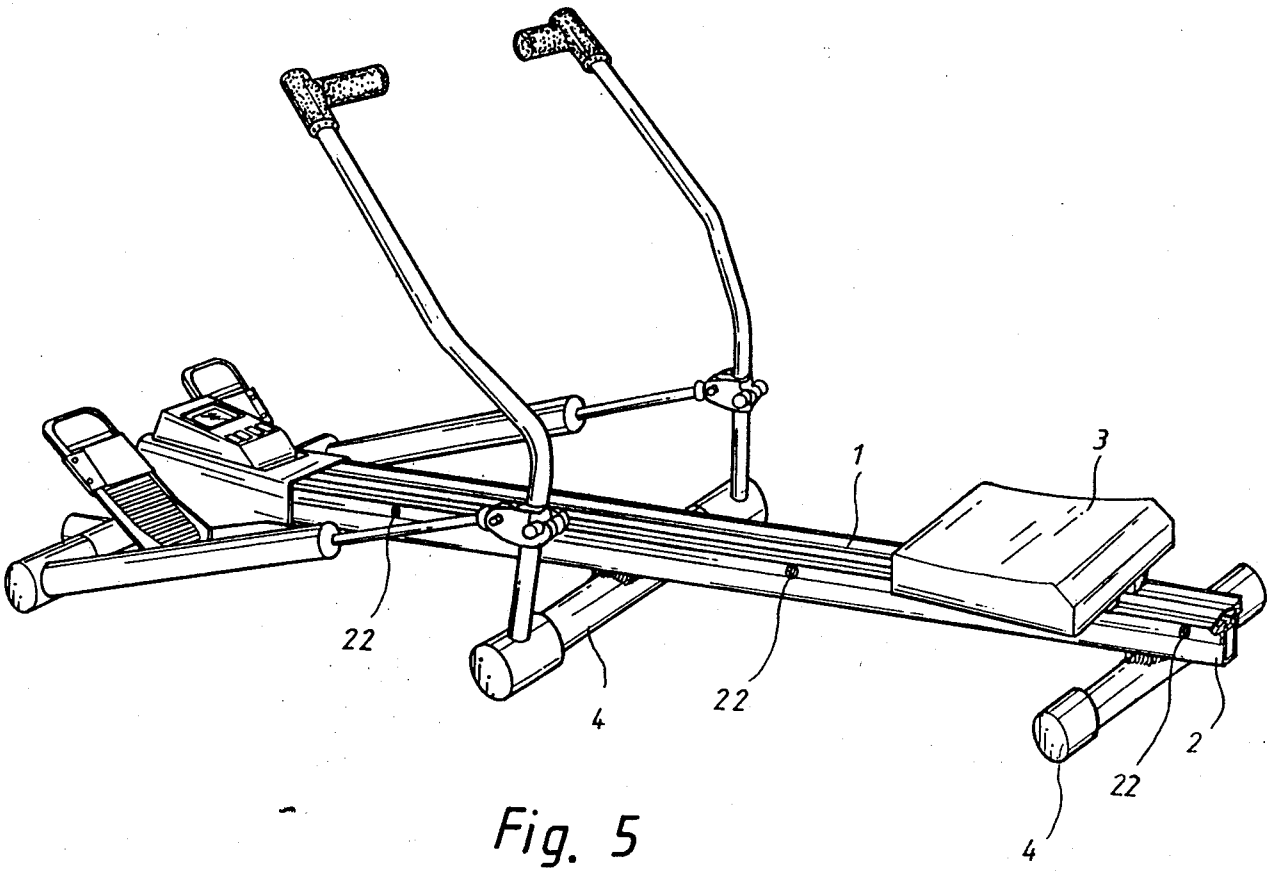
FIG. 5 is a perspective view of the embodiment of the rowing exercising machine using the sliding rail construction of the present invention.

As shown in FIG. 5, the seat pad 3 can therefore be placed upon the sliding rail and the rollers provided on the bottom of the seat pad engage with the troughs of the sliding rail so as to permit smooth sliding thereon. Since the rail base 2 is made of ferrous metal, it can be fixed onto the base rods 4 which are also made of ferrous metal by ordinary welding process. Such an improved sliding rail construction not only avoids the difficulties and high cost of using Argon welding, but also improves the quality of the product at a comparatively low cost.

Figure 3:
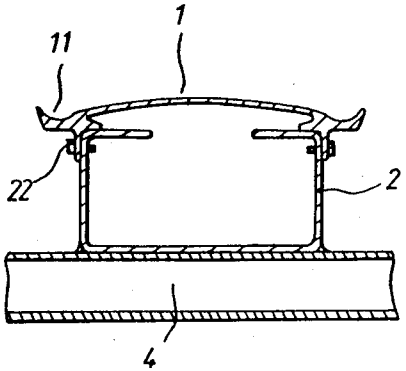
FIGS. 3 and 4 are section views of other embodiments of the sliding rail constructions of the present invention after assembling.
Figure 4:
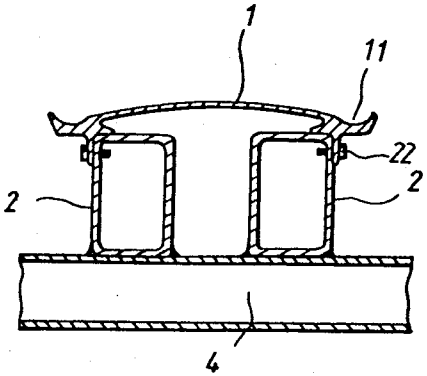

FIGS. 3 and 4 show the other embodiments of the sliding rail construction of the present invention and in comparison with the construction shown in FIG. 1, the main difference resides in that, the rail base 2 illustrated in FIGS. 3 and 4, is formed by shape irons having different geometric shapes with respect to their cross sections. The cross section of the rail base 2 in FIG. 3 has a generally rectangular shape with a longitudinal gap formed on one of its side, as for the rail base 2 used in FIG. 4, it is formed by a pair of smaller shape irons with rectangular cross sections individually. Both of these rail bases 2 can still provide the desired support for the upper sliding stripe 1.

It is understood that the forgoing description and accompanying illustrations are merely exemplary, and various changes and modifications to the preferred embodiments will be apparent to those skilled in the art. Hence, the scope of the invention is defined solely by the appended claims and their equivalents.

I claim:

1. A sliding rail construction in combination with a rowing exercising machine, comprising:

an upper sliding strip, made of aluminum alloy, having sliding troughs on its upper surface, and mounting means on its bottom surface; and a rail base, made of ferrous metal, having holding means for receiving said mounting means to provide firm connection between said upper sliding stripe and said rail base.

2. A sliding rail construction in combination with a rowing exercise machine as described in claim 1, wherein said mounting means of said upper sliding stripe comprising:

two flanges projecting downwardly from the bottom surface of said sliding stripe and the distance between the confronting surfaces of said two flanges being about the same as the width of said rail base; and a plurality of bolt holes equidistantly formed on both sides of said flanges.

3. A sliding rail construction in combination with a rowing exercising machine as described in claim 2, wherein said holding means of said base rail comprising:

a plurality of threaded holes equidistantly formed on the vertical sides of said base rail corresponding to the bolt holes formed on said flanges of said upper sliding stripe for connecting with said upper sliding stripe by means of bolt screws.

* * * * *